US012410565B2

(12) United States Patent
Christensen

(10) Patent No.: US 12,410,565 B2
(45) Date of Patent: Sep. 9, 2025

(54) COMPACTING ROLLER WITH AN ELECTRONIC BALANCING SYSTEM FOR MAINTAINING THE ROLLER IN AN UPRIGHT POSITION

(71) Applicant: Dynapac Compaction Equipment AB, Karlskrona (SE)

(72) Inventor: Hans Christensen, Karlskrona (SE)

(73) Assignee: Dynapac Compaction Equipment AB (SE)

( * ) Notice: Subject to any disclaimer, the term of this patent is extended or adjusted under 35 U.S.C. 154(b) by 840 days.

(21) Appl. No.: 17/763,235

(22) PCT Filed: Sep. 25, 2020

(86) PCT No.: PCT/SE2020/000023
§ 371 (c)(1),
(2) Date: Mar. 24, 2022

(87) PCT Pub. No.: WO2021/061032
PCT Pub. Date: Apr. 1, 2021

(65) Prior Publication Data

US 2022/0341103 A1 Oct. 27, 2022

(30) Foreign Application Priority Data

Sep. 25, 2019 (SE) ..... 1951081-7

(51) Int. Cl.
*E01C 19/28* (2006.01)

(52) U.S. Cl.
CPC ..... *E01C 19/283* (2013.01); *E01C 19/286* (2013.01)

(58) Field of Classification Search
CPC ..... E01C 19/286; E01C 19/283; E01C 19/28
See application file for complete search history.

(56) References Cited

U.S. PATENT DOCUMENTS

| | | | | |
|---|---|---|---|---|
| 2,549,182 | A | 4/1951 | Ekenstam | |
| 11,066,789 | B2 * | 7/2021 | Darscheid | E01C 19/286 |
| 2017/0342668 | A1 * | 11/2017 | Meindl | E01C 19/286 |
| 2022/0162812 | A1 * | 5/2022 | Cserw | B60L 50/15 |

FOREIGN PATENT DOCUMENTS

| | | | |
|---|---|---|---|
| GB | 942941 | A | 11/1963 |
| GB | 1072160 | A | 6/1967 |
| WO | 2018/234844 | A1 | 12/2018 |

* cited by examiner

*Primary Examiner* — Abigail A Risic
(74) *Attorney, Agent, or Firm* — Condo Roccia Koptiw LLP

(57) ABSTRACT

The present invention relates to a compacting roller (1) comprising a roller drum arrangement (3) comprising a first roller drum (9) and a second roller drum (11) arranged next to each other, a drive arrangement (13) comprising a first drive unit (15) arranged to rotate said first roller drum (9) and a second drive unit arranged to rotate said second roller drum (11), and a power supply (39). The compacting roller by further comprises a frame (5) which is connected to said roller drum arrangement (3), wherein said power supply (39) is attached to said frame (5) outside each of the first roller drum (9) and the second roller drum (11), and an electronic balancing system (43) for maintaining the compacting roller (1) in an upright position during operation.

20 Claims, 5 Drawing Sheets

COMPACTING ROLLER WITH AN ELECTRONIC BALANCING SYSTEM FOR MAINTAINING THE ROLLER IN AN UPRIGHT POSITION

CROSS REFERENCE TO RELATED APPLICATIONS

This application is the National Stage Entry under 35 U.S.C. § 371 of Patent Cooperation Treaty Application No. PCT/SE2020/000023, filed Sep. 25, 2020, which claims priority from Swedish Application No. 1951081-7, filed Sep. 25, 2019, the entire contents of each of which are hereby incorporated by reference herein.

TECHNICAL FIELD OF THE INVENTION

The present invention relates to a compacting roller comprising a roller drum arrangement comprising a first roller drum and a second roller drum arranged next to each other, a drive arrangement comprising a first drive unit arranged to rotate said first roller drum and a second drive unit arranged to rotate said second roller drum.

BACKGROUND ART

Compacting rollers are widely used to compact soil and asphalt e.g. in the construction of roads and buildings.

WO 2018/234844 A1 illustrates a compacting roller having two cylindrical drums positioned next to each other. The roller is driven by one or more motors positioned within the cylindrical space defined by the cylindrical drums. The compacting roller further includes a counterweight positioned within the cylindrical space defined by the cylindrical drums.

However, this roller is considered to have a complex design. Also, it may be considered cumbersome to carry out service and maintenance on such a roller.

SUMMARY OF THE INVENTION

It is an object of the present invention to provide an improved compacting roller.

This and other objects that will be apparent from the following summary and description are achieved by a compacting roller according to the appended claims.

According to one aspect of the present disclosure there is provided a compacting roller comprising a roller drum arrangement comprising a first roller drum and a second roller drum arranged next to each other, a drive arrangement comprising a first drive unit arranged to rotate said first roller drum and a second drive unit arranged to rotate said second roller drum, and a power supply, wherein the compacting roller further comprises a frame which is connected to said roller drum arrangement, wherein said power supply is attached to said frame outside each of the first roller drum and the second roller drum, and an electronic balancing system for maintaining the compacting roller in an upright position during operation.

A self-balancing roller, that may be autonomous or remotely controlled, is thus provided. This roller may significantly reduce the number of machine operators needed at a construction site. The frame of the roller enables a power supply to be located outside the roller drums. Such an external position of a power supply, i.e. outside the roller drums of the roller drum arrangement, allows for a relatively large power supply. Especially, this is advantageous when drive units in the form of electric motors, which may require a relatively large battery pack to obtain a desired range, are used. A compacting roller having a very long working period may thus be achieved, since a power supply may be located outside the roller drums. Furthermore, the external position of the power supply facilitates charging, refueling and/or exchange of the power supply. Also, it makes it possible, or at least easier, to include a vibratory mechanism inside the roller drums, since such a location of the power supply provides space for a vibratory mechanism within the space defined by the roller drums of the roller drum arrangement. A further advantage is that a roller with easily accessible service points may be provided, which facilitates maintenance and service of the roller. Also, the frame, which may be designed to carry a substantial load, outside the roller drums facilitates to achieve a desired static linear load and enables a roller with a very high static linear load. Hence, a roller capable of performing compaction work in a very efficient manner may be provided.

The electronic balancing system comprises an inertial measurement unit and a feedback control system.

According to one embodiment the inertial measurement unit and/or the feedback control system is/are arranged inside a housing and/or a compartment of the compacting roller. This embodiment has the advantage that sensitive component(s) is/are protected from being damaged. Such a housing or compartment may form a part of the frame of the compacting roller or may be formed by a separate part connected to the frame of the compacting roller.

According to one embodiment the compacting roller is autonomous, which may reduce the number of construction workers at a construction site to a great extent.

According to one embodiment the compacting roller comprises a vibratory mechanism, and/or an oscillatory mechanism, for dynamic compaction.

According to one embodiment at least one of said first and second drive units comprises an electric motor, which provides for a very environmentally friendly and cost-efficient roller. Also, such a roller provides for a very silent working environment. A battery, preferably a Li-ion battery, and/or an electric energy generator may be used as a power supply for the drive arrangement as well as for components of the balancing system.

According to one embodiment at least one of said first and second drive units comprises a hydraulic motor.

According to one embodiment said power supply comprises a battery, and/or fuel cells and/or a combustion engine.

According to one embodiment the roller is provided with at least one scraper device. Preferably, said scraper device is mounted to the frame of the roller.

According to one embodiment the roller is provided with at least one sprinkler device. Preferably, said sprinkler device is mounted to the frame of the roller.

According to one embodiment the roller is provided with at least one foldable stand. Preferably, said foldable stand is mounted to the frame of the roller.

These and other aspects of the invention will be apparent from and elucidated with reference to the claims and the embodiments described hereinafter.

BRIEF DESCRIPTION OF THE DRAWINGS

The invention will now be described in more detail with reference to the appended drawings in which.

DETAILED DESCRIPTION OF PREFERRED EMBODIMENTS OF THE INVENTION

Figure 1:
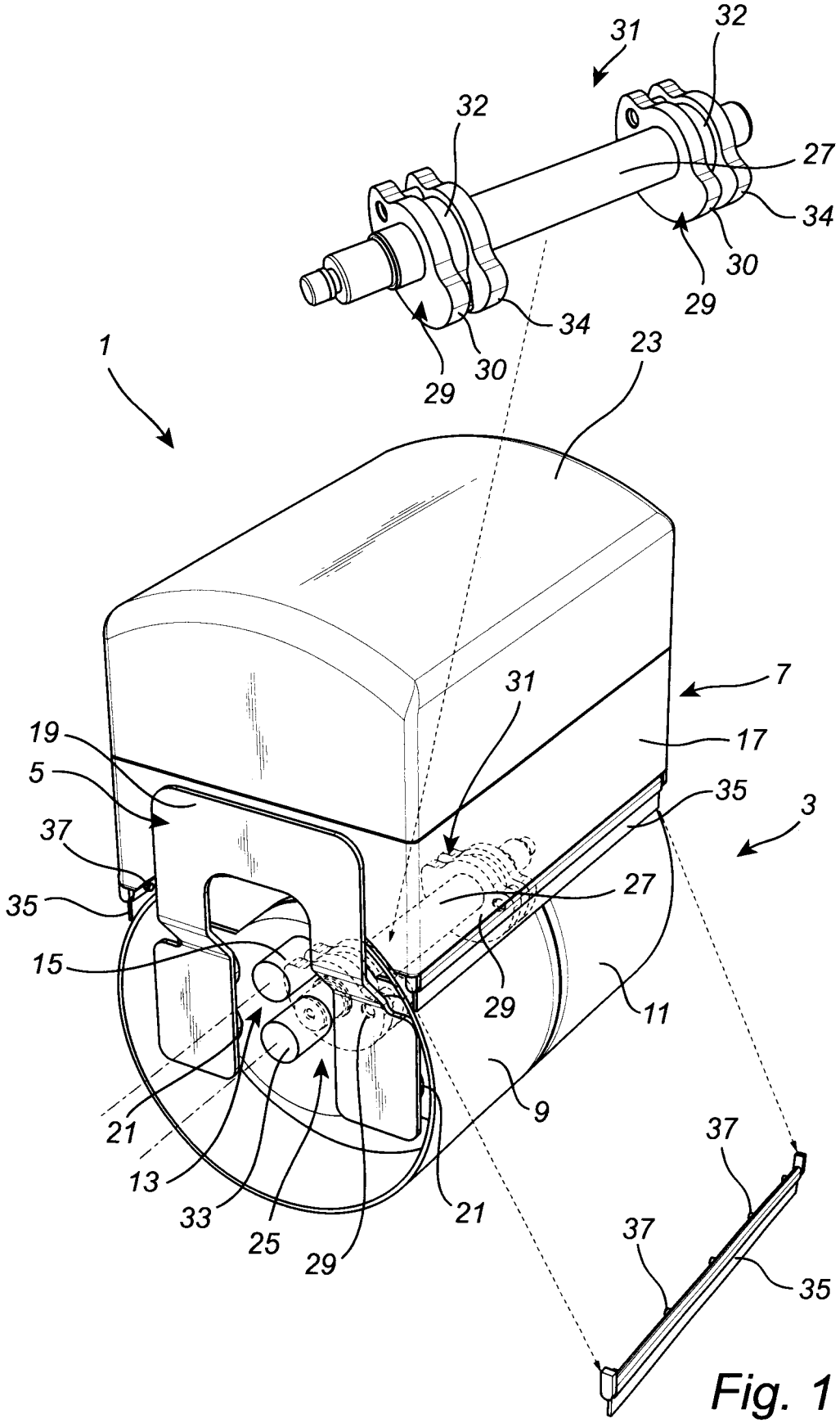
FIG. 1 illustrates a compacting roller according to an embodiment of the present disclosure.

FIG. 1 illustrates a compacting roller, in the form of an autonomous vibratory roller 1, according to an embodiment of the present disclosure.

The vibratory roller 1 comprises a roller drum arrangement 3, a frame 5, which is connected to the roller drum arrangement 3, and a housing 7.

The roller drum arrangement 3 comprises a first roller drum 9 and a second roller drum 11 arranged next to each other in a split configuration allowing independent rotation of the first roller drum 9 and the second roller drum 11.

The vibratory roller 1 further comprises a drive arrangement 13 for driving each of the first drum roller 9 and the second drum roller 11. To this end, the drive arrangement 13 comprises a first drive unit 15 arranged to rotate the first roller drum 9 and a second drive unit (not shown) arranged to rotate the second roller drum 11. Each of the first drive unit 15 and the second drive unit is connected to a power supply situated in the housing 7.

The frame 5 comprises a box-shaped central portion 17, a first fork leg 19, which is connected to the drum arrangement 3 at one side by means of a first bearing arrangement 21, and a second fork leg (not shown) which is connected to the drum arrangement 3 at an opposite side by means of a second bearing arrangement (not shown). Each of the fork legs 19 has the shape of an inverted U as seen in a longitudinal direction of the roller drum arrangement 3. The central frame portion 17 and a removable cover 23 together forms the housing 7 of the vibratory roller 1.

The vibratory roller 1 further comprises a vibratory mechanism 25 for dynamic compaction. The vibratory mechanism 25 comprises a rotatable shaft 27 to which two identical eccentric mass assemblies 29 are mounted and which is rotatably arranged by means of roller bearings. The rotatable shaft 27 and the two eccentric mass assemblies 29 together form an eccentric shaft 31 that is rotatable by means of a third drive unit 33. Upon rotation of the eccentric shaft 31 a cyclic force that increases the compacting force of the roller drum arrangement 3 is generated. Each eccentric mass assembly 29 comprises three eccentric masses 30, 32, 34 two of which are fixed to the rotatable shaft 27 and one of which is movably mounted on the shaft 27. Each of the movable masses 32 is free to rotate relative to the fixed masses 30, 34 between a first position, in which it cooperates with the two fixed masses 30, 34 upon rotation of the shaft 27 in one direction, and a second position, in which it partly balances the two fixed masses 30, 34 upon rotation of the shaft 27 in the opposite direction.

When the movable masses 32 are situated in their respective first positions, the vibratory mechanism 25 operates in a high amplitude setting and when the movable masses 32 are situated in their respective second positions, the vibratory mechanism 27 operates in a low amplitude setting.

The amplitude setting is switched from one to the other by changing the direction of rotation of the shaft 27. To this end, each of the movable masses 32 has two engagement portions configured to engage a driving pin secured to the two fixed masses 30, 34 so as to rotate therewith as the shaft 27 rotates in any direction. High amplitude/low frequency or low amplitude/high frequency may thus be controlled by the direction of rotation of the eccentric shaft 31.

The vibratory roller 1 further comprises two scraper devices 35, each of which is supported by the central frame portion 17. As illustrated in FIG. 1, each of the scraper devices 35 comprises several nozzles 37 distributed along the length thereof for spraying liquid, preferably water, on the surfaces of the drum rollers 9, 11. Each of the nozzles 37 is connected to a respective liquid tank, which is situated in the housing 7, by means of liquid tubes (not shown). The nozzles 37, the liquid tubes, the liquid tanks and a water pump (not shown) together form a sprinkler system that is configured to keep the drum rollers 9, 11 wet.

Figure 2:
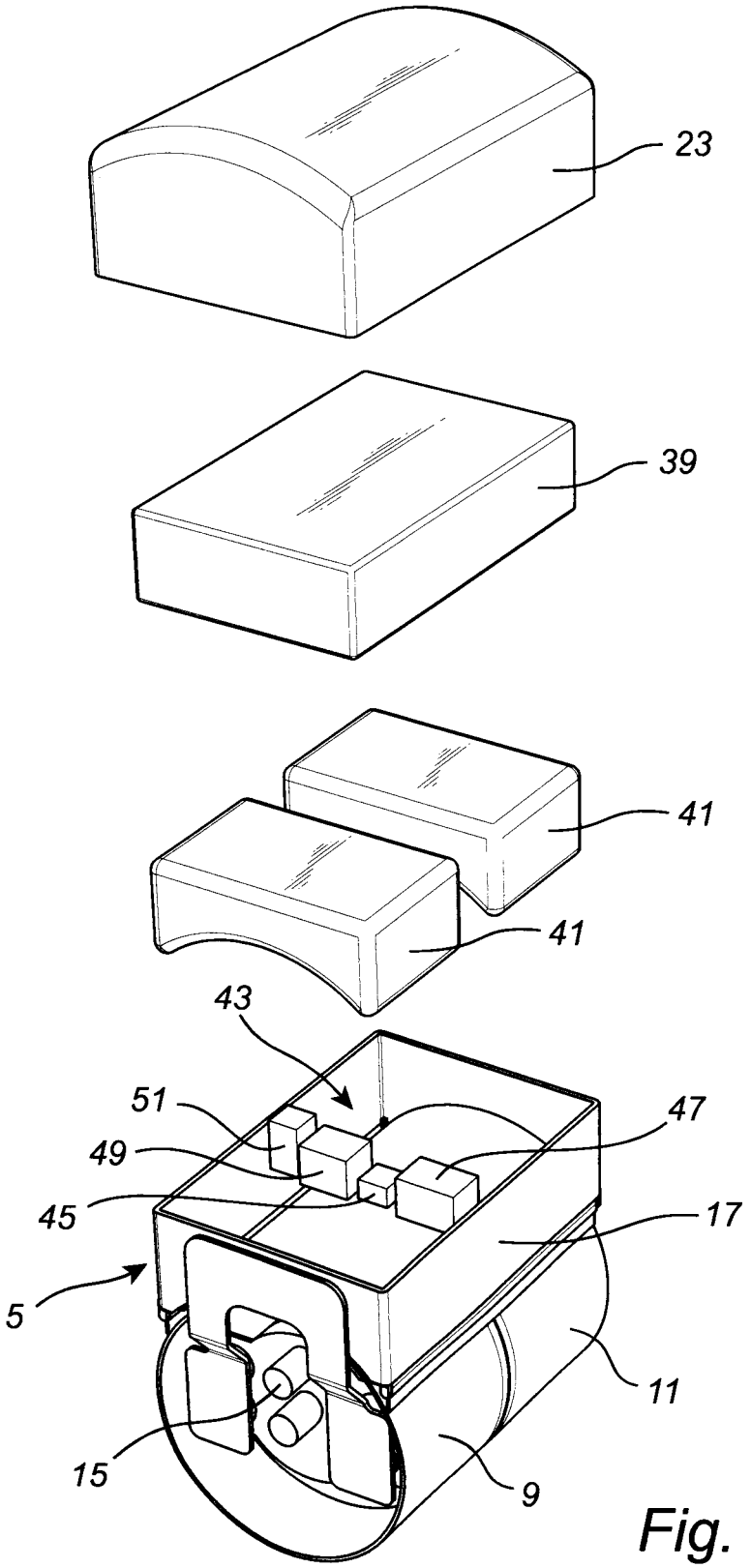
FIG. 2 is a partly exploded view and illustrates components of the compacting roller shown in FIG. 1.

Now referring to FIG. 2, the power supply, which in this embodiment is a Li-ion battery pack 39, is situated in an upper part of the housing 7, and the liquid tanks, which in this embodiment are water tanks 41, are situated in a lower part of the housing 7. Each of the battery pack 39 and the water tanks 41 is thus supported by the frame 5 outside the roller drums 9, 11 of the roller drum arrangement 3. The external position of the battery pack 39 outside the roller drums 9, 11 allows for a relatively large battery pack 39 and/or large water tanks 41. Furthermore, it facilitates charging and/or exchange of the battery pack 39, since it is easy to get access thereto by simply removing the cover 23.

The compacting roller 1 further comprises a balancing system 43 for maintaining the vibratory roller 1 in an upright position during operation. The balancing system 43 comprises an inertial measurement unit 45, an electrical control unit 47 and a drive control unit 49. Each of the inertial measurement unit 45, the electrical control unit 47 and the drive control unit 49 is situated in and supported by the central frame portion 17 of the frame 5, as schematically illustrated in FIG. 2. In this embodiment, each of the inertial measurement unit 45, the electrical control unit 47, which comprises a feedback control system, and the drive control unit 49 is thus arranged inside a compartment formed by the central frame portion 17 of the frame 5.

The inertial measurement unit 45 is an electronic device that is capable of measuring and reporting a body's specific force and angular rate etc. More specifically, the inertial measurement unit 45 works by detecting linear acceleration using one or more accelerometers and angular rate using one or more gyroscopes. The inertial measurement unit 45 senses when the frame 5 is leaning and in what direction. By way of an example the inertial measurement unit 45 may comprise one accelerometer and gyro for the yaw axis of the vibratory roller 1 as well as one accelerometer and gyro for the pitch axis of the vibratory roller. It is however appreciated that the inertial measurement unit may contain one accelerometer and gyroscope for each of the compacting roller's axes: pitch, roll and yaw. A commercially available inertial measurement unit (IMU) may be used.

The electrical control unit 47 comprises a feedback control system that utilizes a PID feedback control loop to maintain the vibratory roller 1 in an upright position by controlling the two drive units 15 of the drive arrangement 13. The drive units 15 are thus controlled to correct for an induced lean angle by moving the roller forward and backward. Each of the drive units 15 is controlled via the drive control unit 49. Hence, with the help of torque in the drive units 15 the vibratory roller 1 will keep itself upright, drive forward, reverse or turn. To turn, the drive control unit 49 will control the drive units 15 such that torque with different direction on each of the roller drums 9, 11 is applied.

The roller 1 further comprises a navigation system 51 which is situated in and supported by the central frame portion 17 of the frame 5.

Figure 3:
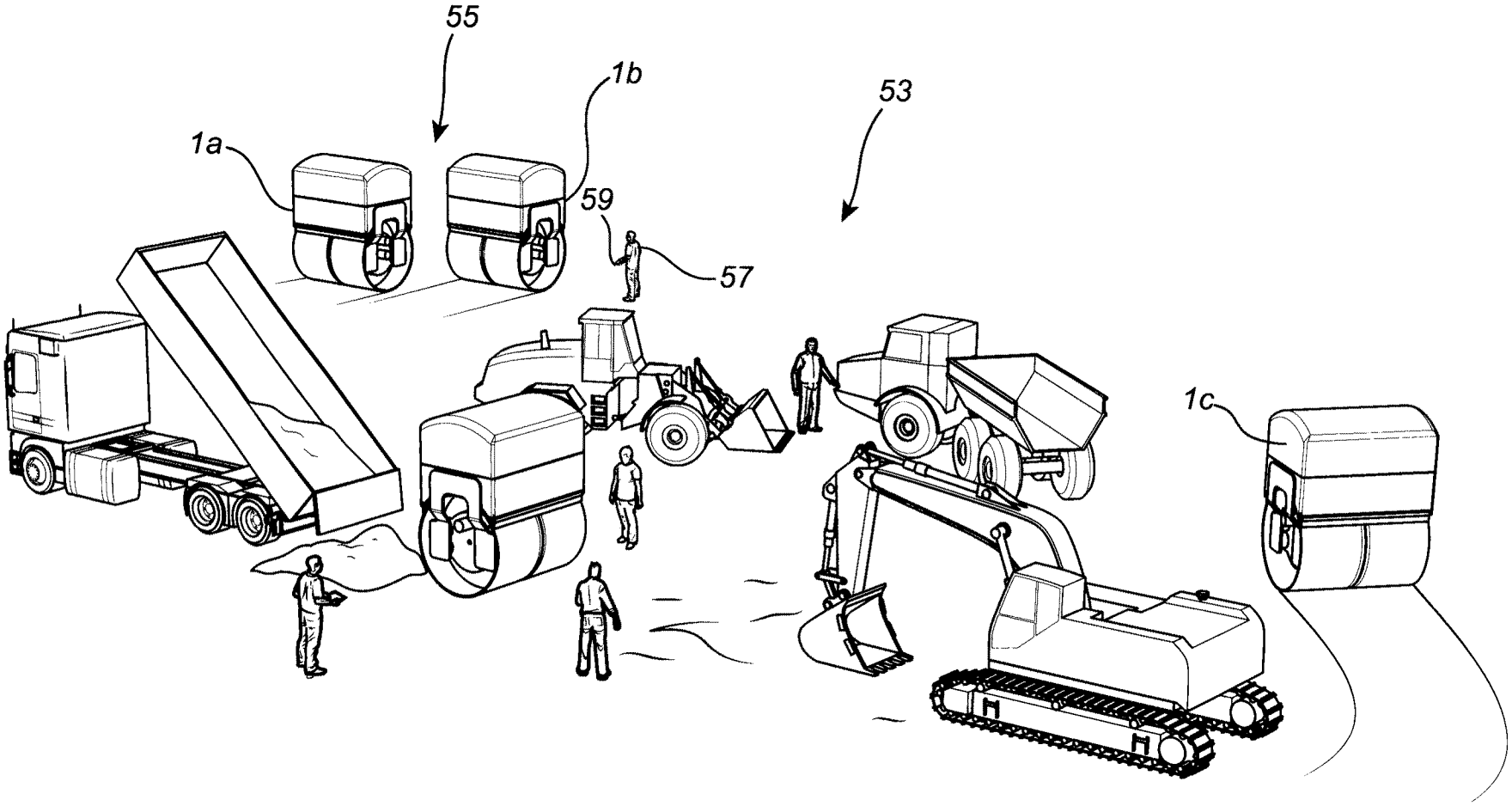
FIG. 3 serves to illustrate use of compacting rollers according to embodiments of the present disclosure.

FIG. 3 illustrates a construction site 53 where a working area 55 with gravel is compacted by two vibratory rollers. A first roller 1*a* is controlled autonomously using a common control system (not shown) for several autonomous rollers and a second vibratory roller 1*b* is remotely controlled by an operator 57 by means of a remote control 59. A third vibratory roller, in the form of an autonomous vibratory roller 1*c* connected to the common control system, is on its way to the working area 55 to assist the first and second vibratory rollers 1*a*, 1*b* in compacting the working area 55. The navigation system 51, which is connected to the common control system, is used to guide the roller 1*c* to the working area 55.

The vibratory roller 1 may be used to compact different material, such as e.g. asphalt, gravel and different types of soil, and is thus suitable for a wide variety of applications. For asphalt the roller may follow an asphalt roller and compact the area being paved by the asphalt roller. For gravel it may, with gps or some other navigation system, be instructed to compact a certain area. The area to be compacted could be restricted on a digital map, by using several beacons (minimum of 3) or by learning a track.

Figure 4:
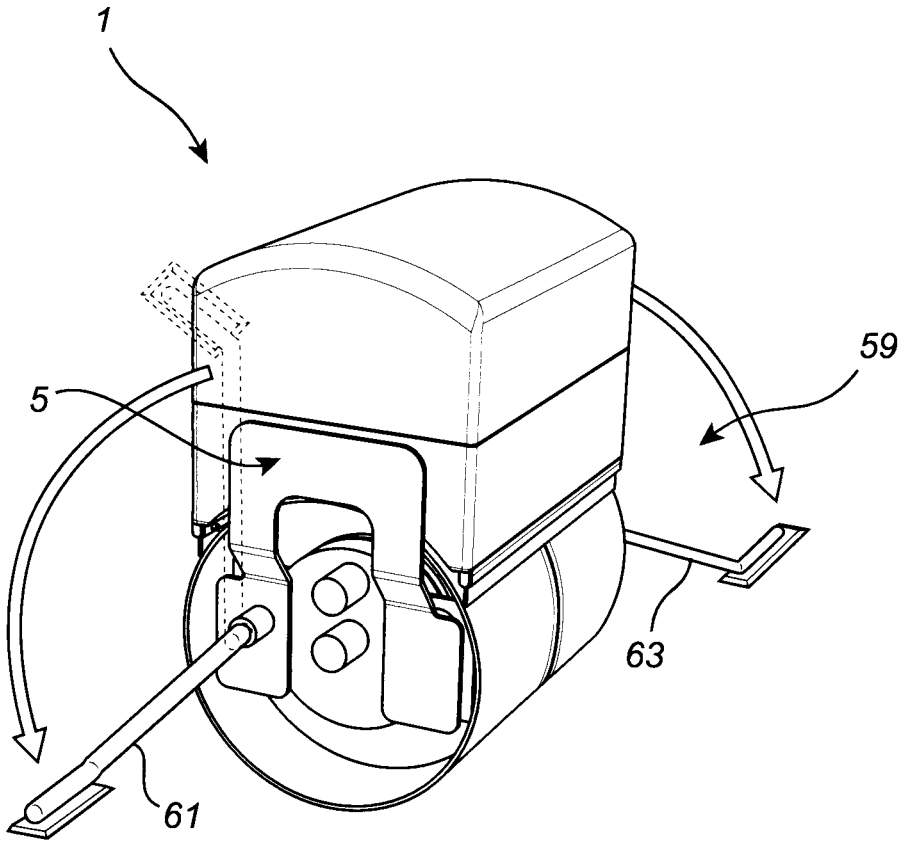
FIG. 4 illustrates an integrated support device for maintaining the compacting roller shown in FIG. 1 in an upright position when not in use.

As illustrated in FIG. 4 the vibratory roller 1 may be provided with a support device 59 for maintaining the vibratory roller 1 in an upright position when the balancing system 43 is not active. The support device 59 comprises two foldable stands 61, 63 that are configured to hold the roller 1 in an upright position. Each foldable stand 61, 63 is mounted to the frame 5 of the roller 1. Such a support device 59 may facilitate charging and/or refueling a vibratory roller at a construction site 53. Also it may facilitate transport of a roller 1 to and from a construction site 53 and/or storage of a vibratory roller 1 when not in use. It is appreciated that such a integrated support device may comprise one single foldable stand that is configured to hold a vibratory roller in an upright, or slightly leaning, position.

It will be appreciated that numerous variants of the embodiments described above are possible within the scope of the appended claims.

Hereinbefore, with reference to FIG. 1, a vibratory mechanism comprising mass assemblies, each of which mass assembly comprises two fixed masses and one movable mass, has been described. It is appreciated that other types of dual-amplitude vibratory mechanisms may be used. Also, it is appreciated that a vibratory mechanism having more or less predefined amplitude settings, or a vibratory mechanism having continuously variable amplitude, may be used.

Hereinbefore, with reference to FIG. 1, a roller having a vibrating drum arrangement has been described. It is appreciated that the roller instead may be equipped with a static or an oscillating drum arrangement.

Figure 5:
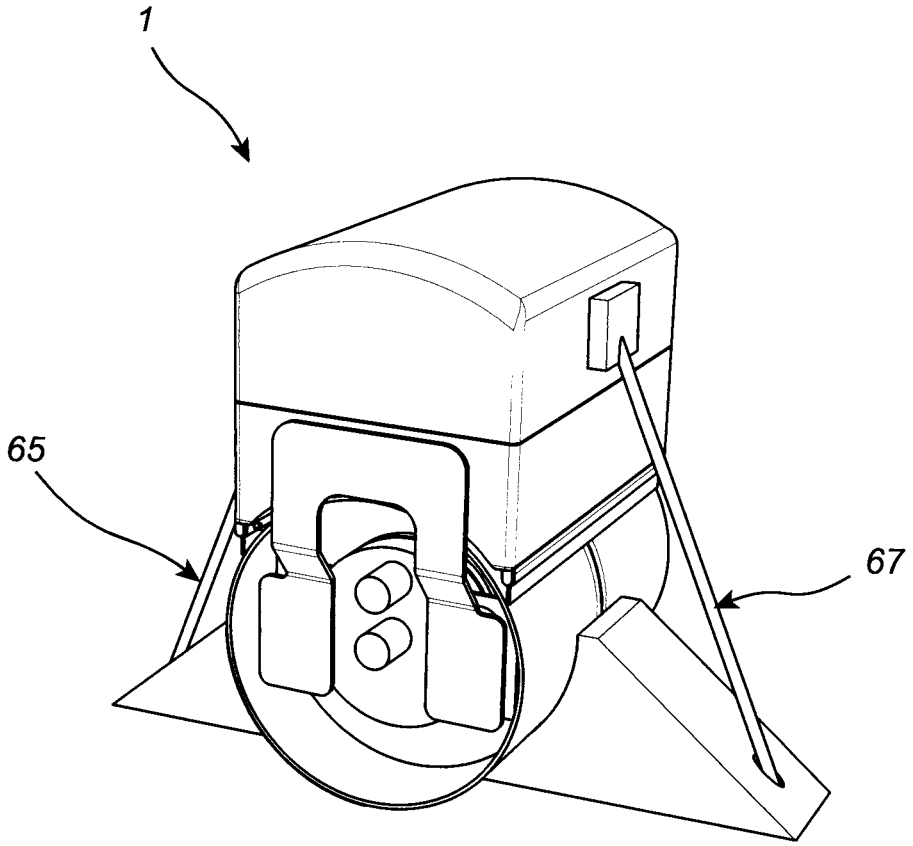
FIG. 5 illustrates a separate support device for maintaining a vibratory roller according to the present disclosure in an upright position when not in use.

Also it has been described, with reference to FIG. 4, that one or more foldable stand(s) may be used to keep the roller upright when the balancing system of the roller is not active. It is appreciated that, instead of such an integrated support device 59, one or more separate support structure(s) 65, 67 may be used to maintain the vibratory roller 1 in an upright position when the balancing system is not active, as illustrated in FIG. 5.

Hereinbefore, with reference to FIG. 2, it has been described that each of the inertial measurement unit 45 and the electrical control unit 47, which comprises a feedback control system, may be arranged inside a compartment formed by the central frame portion 17 of the frame 5. It is appreciated that the inertial measurement unit and/or the feedback control system may be arranged inside a housing or compartment formed by a separate part connected to the frame of the compacting roller. Furthermore, it is appreciated that the inertial measurement unit and/or the feedback control system may be arranged outside a housing or compartment of the compact roller. The inertial measurement unit and/or the feedback control system may thus be mounted on the frame, or on a part connected to the frame, of the compact roller.

The invention claimed is:

1. A compacting roller comprising:

a frame;

a roller drum arrangement attached to the frame, wherein the roller drum arrangement comprises a first roller drum and a second roller drum arranged next to each other;

a drive arrangement comprising a first drive unit arranged to rotate the first roller drum and a second drive unit arranged to rotate the second roller drum;

a power supply connected to the first drive unit and the second drive unit, wherein the power supply is attached to the frame outside each of the first roller drum and the second roller drum; and an electronic balancing system for maintaining the compacting roller in an upright position during operation, wherein the electronic balancing system comprises an inertial measurement unit and a feedback control system.

2. The compacting roller of claim 1, wherein the frame defines at least part of a housing.

3. The compacting roller of claim 2, wherein one or more of the inertial measurement unit and the feedback control system is arranged inside the housing.

4. The compacting roller of claim 2, further comprising a navigation system arranged inside the housing.

5. The compacting roller of claim 1, wherein the compacting roller is autonomous.

6. The compacting roller of claim 1, further comprising a vibratory mechanism.

7. The compacting roller of claim 1, further comprising an oscillatory mechanism.

8. The compacting roller of claim 1, wherein one or more of the first drive unit and the second drive unit comprise an electric motor.

9. The compacting roller of claim 1, wherein one or more of the first drive unit and the second drive unit comprise a hydraulic motor.

10. The compacting roller of claim 1, wherein the power supply comprises a battery and/or fuel cells.

11. The compacting roller of claim 1, wherein the power supply comprises a combustion engine.

12. The compacting roller of claim 1, further comprising at least one scraper device.

13. The compacting roller of claim 1, further comprising at least one sprinkler device.

14. The compacting roller of claim 1, further comprising at least one foldable stand.

15. A compacting roller comprising:

a frame defining a housing;

an electronic balancing system disposed in the housing for maintaining the compacting roller in an upright position during operation, the electronic balancing system comprising an inertial measurement unit and a feedback control system; and a power supply disposed in the housing for supplying power to the electronic balancing system and a drive unit connected to a roller drum arrangement attached to the frame below the housing, the roller drum arrangement comprising a roller drum.

16. The compacting roller of claim 15, further comprising a vibratory mechanism.

17. The compacting roller of claim 15, further comprising a navigation system arranged in the housing.

18. The compacting roller of claim 15, wherein the compacting roller is autonomous.

19. The compacting roller of claim 15, wherein the power supply comprises a battery.

20. The compacting roller of claim 19, wherein the drive unit is an electric motor.

* * * * *